US006954609B2

(12) United States Patent
Ito

(10) Patent No.: US 6,954,609 B2
(45) Date of Patent: Oct. 11, 2005

(54) IMAGE FORMING APPARATUS FEATURING A CLEANING BRUSH FOR REMOVING RESIDUAL DEVELOPER

(75) Inventor: Masahiro Ito, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/667,323

(22) Filed: Sep. 23, 2003

(65) Prior Publication Data

US 2004/0057761 A1 Mar. 25, 2004

(30) Foreign Application Priority Data

Sep. 24, 2002 (JP) ..... 2002-277545
Sep. 9, 2003 (JP) ..... 2003-317541

(51) Int. Cl.[7] ..... G03G 21/00
(52) U.S. Cl. ..... 399/353; 399/349
(58) Field of Search ..... 399/159, 252, 399/343, 346, 349, 353; 347/112; 430/32, 56, 105, 120

(56) References Cited

U.S. PATENT DOCUMENTS

| | | | | |
|---|---|---|---|---|
| 4,461,819 A | | 7/1984 | Nakagawa et al. | 430/59 |
| 4,551,405 A | | 11/1985 | Nakagawa et al. | 430/64 |
| 4,557,990 A | | 12/1985 | Nakagawa et al. | 430/84 |
| 4,613,558 A | | 9/1986 | Nakagawa et al. | 430/84 |
| 4,670,369 A | | 6/1987 | Nakagawa et al. | 430/128 |
| 4,674,865 A | | 6/1987 | Tada et al. | |
| 4,741,942 A | * | 5/1988 | Swift | 399/353 X |
| 5,138,381 A | * | 8/1992 | Masaki et al. | 399/159 |
| 5,391,449 A | * | 2/1995 | Maruyama et al. | 399/159 X |
| 5,436,714 A | | 7/1995 | Suzuki | |
| RE35,198 E | | 4/1996 | Nakagawa et al. | 430/59 |
| 5,624,776 A | * | 4/1997 | Takei et al. | 430/56 |
| 5,625,443 A | * | 4/1997 | Ohta et al. | 399/353 |
| 5,659,857 A | * | 8/1997 | Yamazaki et al. | 399/252 |
| 5,671,476 A | | 9/1997 | Ishiguro et al. | 399/354 |
| 5,689,791 A | * | 11/1997 | Swift | 399/353 |
| 6,415,129 B2 | * | 7/2002 | Sawayama | 399/353 |
| 6,775,511 B2 | * | 8/2004 | Kosuge | 399/346 |

FOREIGN PATENT DOCUMENTS

| | | |
|---|---|---|
| JP | 54-143645 | 11/1979 |
| JP | 11-212417 | 8/1999 |
| JP | 2000-75752 | 3/2000 |

* cited by examiner

*Primary Examiner*—Sandra L. Brase
(74) *Attorney, Agent, or Firm*—Fitzpatrick, Cella, Harper & Scinto

(57) ABSTRACT

An electrophotographic apparatus comprises a photosensitive member, exposing means, and cleaning means for cleaning a residual developer from the photosensitive member, which comprises a cleaning brush brought into contact with the photosensitive member. In this case, a brush density of the cleaning brush is D (number/mm$^2$), and an area of a pixel of an electrostatic image is S (mm$^2$/dot), and $D \times S \geqq 0.06$ and $D \leqq 200$ are satisfied. Thus, an image forming apparatus is provided, in which cleaning stability is improved by uniformly scraping off and dispersing the transfer residual developer from the photosensitive member.

14 Claims, 4 Drawing Sheets

IMAGE FORMING APPARATUS FEATURING A CLEANING BRUSH FOR REMOVING RESIDUAL DEVELOPER

BACKGROUND OF THE INVENTION

1. Field of the Invention

The present invention relates to an electrophotographic apparatus such as a copying machine, a printer or a facsimile which forms an image by using an electrophotographic system, and more particularly to an image forming apparatus which has a cleaning member for cleaning residual toner left on a surface of a photosensitive member.

2. Description of the Related Art

Generally, in an image forming apparatus such as a copying machine, a printer or a facsimile which records an image on a recording medium such as paper, an electrophotographic system is adopted as a system to record the image on the recording medium. In the electrophotographic system, a photosensitive drum as a photosensitive member, on a surface of which a photosensitive substance is coated, is used as an image bearer (or image carrier member). First, after the surface of the photosensitive drum is uniformly charged, the surface of the photosensitive drum is irradiated with a laser beam, and a potential difference is applied between an irradiated portion and a nonirradiated portion. Then, charged toner contained in a developer adheres to the surface of the photosensitive drum to form a toner image on the surface of the photosensitive drum. Subsequently, the toner image is transferred to the recording medium as an image receiving member, and an image is formed on the recording medium.

As described above, as a latent image forming system to carry out image formation by the electrophotographic system, in the case of an analog exposing system which has conventionally been used widely for the copying machine etc., noise is readily picked up. In particular, for color image formation in which image forming conditions are strict, an image forming method which includes a step of forming a dot latent image on an image bearer by switching a laser beam ON/OFF in accordance with a digital image signal has come into wide practical use. In the case of such a method, a binary recording system suffices for an image such as a character. However, the system is insufficient for reproduction of a halftone image such as a photograph which is essential. Thus, a dither method, a density pattern method, etc., have been presented as means capable of reproducing halftone images by the binary recording system.

However, since high resolution cannot be obtained by such means, as means for solving the problem, a method has been presented which can obtain a high-resolution image by modulating a pulse width (PWM) of a laser beam image signal to carry out area gradation by dots for each pixel, and forming a good halftone image without reducing a pixel density for recording. This is now a mainstream color image forming method in which image forming conditions are strict, and resolution has become higher and higher from 600 dpi to 800 dpi, and to 1200 dpi. A reduction in toner diameter is absolutely necessary to stably reproduce the high-resolution latent image and to improve image quality.

With regard to cleaning of the photosensitive member in the electrophotographic system, the surface of the photosensitive drum is repeatedly used for toner image formation many times, so that after the transfer of the toner image to the recording medium, it is necessary to sufficiently remove residual toner left on the surface of the photosensitive drum without being transferred to the recording medium. Many methods have conventionally been presented to remove residual toner. A method for scraping off the residual toner by abutting a cleaning blade which is a rubber blade made of an elastic material on the surface of the photosensitive drum in a counter direction has been put into wide practical use, because costs are low, the entire electrophotographic system can be constituted to be simple and compact, and toner removing efficiency is high. As a material of the cleaning blade, urethane rubber is generally used which is high in hardness, elasticity, wear resistance, mechanical strength, oil resistance, ozone resistance, etc.

Additionally, in recent years, polymeric toner generated by a polymerization method has been employed in place of conventional crushed toner generated by a crushing method. Because of its transfer efficiency higher than that of the crushed toner, the polymeric toner has advantages that a cleanerless system is employed, wax is easily contained for production, and no release agents are necessary when the transferred image is fixed. Moreover, sphericity of the polymeric toner is high compared with the crushed toner.

Even in the case of the crushed toner, a reduction in toner particle diameter, and shape spheroidization by considering transfer performance or the like have been carried out.

Generally, when the toner sphericity is increased, if the surface state of the photosensitive drum is unchanged, and abutting pressure of the cleaning blade is set equal to that in the case of the crushed toner, sneaking-through of the toner from the cleaning blade becomes frequent. Generally, in the image forming apparatus which uses the polymeric toner or the spheroidized crushed toner, generally, toner sneaking-through is prevented by increasing the abutting pressure of the cleaning blade or arranging a fur brush or the like as cleaning auxiliary means. As an extension of such a conventional technology, there is a method which controls driving or the like of the fur brush in accordance with a printing density to a transferring material (e.g., see Japanese Patent Application Laid-Open No. 11-212417).

However, in the aforementioned conventional example, a hardware mechanism is necessary to carry out fur brush driving control. Consequently, the apparatus becomes complex, larger in size, and costs become higher for main body.

There has been a limit on improvement of cleaning performance only by a macro image ratio over all the images.

In the aforementioned image forming method, since the latent image is formed in very small pixel units, and the latent image is developed and transferred, the transfer residual toner is left in latent pixel units on the surface of the photosensitive member. Consequently, there is a tendency that places in which transfer residual toner is generated in pixel units are numerous on a pixel center, while generation of transfer residual toner on a boundary in which pixels are adjacent to each other is limited. Especially, in order to form a high-resolution latent image for higher image quality, a film thickness of the photosensitive layer must be set small to suppress an influence of a latent image blur caused by photocarrier diffusion.

However, when the film thickness of the photosensitive layer of the photosensitive member is set small, a certain fixed value is necessary for a photosensitive member surface potential in order to obtain a developing contrast. Thus, electric field intensity on the surface of the photosensitive layer becomes higher corresponding to the thin photosensitive layer. Consequently, electrostatic attraction to toner developed in contact with the surface of the photosensitive member, especially, toner developed on the pixel center, is increased, whereby the toner tends to become transfer residual toner.

Thus, portions with much and little transfer residual toner are formed on the surface of the photosensitive member in a longitudinal direction of the cleaning blade (its orthogonal direction as well). On the portion with little transfer residual toner, sliding performance between the surface of the photosensitive member and the cleaning blade is reduced to cause partial microvibration of the cleaning blade, and the toner tends to sneak through the cleaning blade.

A particle diameter of the used toner is reduced in order to achieve high image quality. As the toner particle diameter becomes smaller, a specific surface area between the toner and the surface of the photosensitive drum becomes larger. Thus, an adhesive force of toner to the surface of the photosensitive drum per unit mass is increased to deteriorate cleaning performance of the surface of the photosensitive drum. Additionally, as the toner particle diameter becomes smaller, toner flowability is deteriorated, and a great amount of additives is necessary. Such a great amount of additives causes problems of wearing or chipping of the cleaning blade, and local line flaws on the surface of the photosensitive drum.

Furthermore, in addition to the reduction in toner particle diameter, recently, there has been an increase in cases of using the polymeric toner generated by spheroidization or polymerization. In the case of using the polymeric toner, as compared with the use of the crushed toner, toner sphericity is high, and toner sneaking-through is frequent. Thus, a linear load of the cleaning blade must be increased. Consequently, there are problems of nonuniformity of a frictional force generated between the photosensitive drum and the cleaning blade in the longitudinal direction, which is influenced by the aforementioned nonuniformity of the transfer residual toner or the like; frequent occurrence of vibration and clashing of the cleaning blade, cleaning failures, cleaning blade reversal, etc. owing to a torque increase of the photosensitive drum which accompanies an increase of a blade pressing force; and a shortened life of the photosensitive drum because of hard wearing of the photosensitive drum.

SUMMARY OF THE INVENTION

An object of the present invention is to provide an image forming apparatus in which cleaning stability is improved by uniformly scraping off and dispersing a transfer residual developer on a photosensitive member.

Another object of the present invention is to provide an image forming apparatus in which cleaning is stable without cleaning failures or the like for a long time.

Another object of the present invention is to provide an image forming apparatus suitable for forming an electrostatic image in accordance with a digital image signal.

Yet another object of the present invention is to provide an image forming apparatus which has a cleaning brush to clean a photosensitive member.

Other objects and features of the present invention will become more apparent upon reading of the following detailed description with reference the accompanying drawings.

DETAILED DESCRIPTION OF THE REFERRED EMBODIMENTS

Next, an electrophotographic apparatus of the present invention will be described in detail by way of embodiments and comparative examples.

First Embodiment

Figure 1:
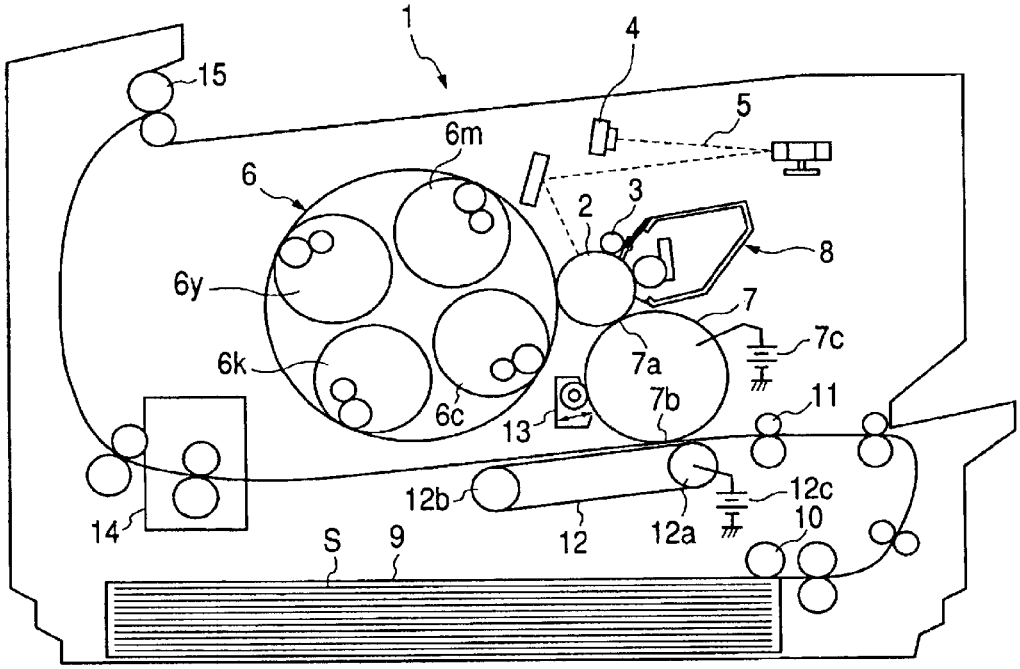
FIG. 1 is a schematic constitutional sectional view of a preferred image forming apparatus of the present invention.

A first preferred embodiment of an image forming apparatus of the present invention will be described with reference to the drawings. FIG. 1 is a schematic constitutional view of the electrophotographic image forming apparatus of the embodiment.

Overall Constitution

An image forming apparatus 1 shown in FIG. 1 is a color copying machine of an electrophotographic system, which forms an image on a recording medium in accordance with an image signal sent from a not-shown computer or the like. A photosensitive member 2 of the image forming apparatus 1 is formed by coating a photosensitive material such as OPC of an outer diameter 62 mm on an outer peripheral surface of a cylinder substrate made of aluminum or the like.

The photosensitive member 2 is rotary-driven at a circumferential speed of 117 mm/sec, and uniformly charged to about −600 V as a dark portion potential VD by a charging roller 3 as contact charging means. Then, a laser oscillator 4 as exposing means scans and exposes a laser beam 5 ON/OFF controlled in accordance with image information (digital image signal) to form an electrostatic latent image of about −200 V as a light portion potential VL on the photosensitive member 2.

The electrostatic latent image formed in the above manner is developed to be visible by a rotary developing apparatus 6 as developing means using toner which is a developer. This rotary developing apparatus 6 is constituted by integrating a first developing device 6*y* which contains yellow toner as first color toner, a second developing device 6*m* which contains magenta toner as second color toner, a third developing device 6*c* which contains cyan toner as third color toner, and a fourth developing device 6*k* which contains black toner as fourth color toner.

First, the first electrostatic latent image is developed to be visible by the first developing device 6*y* which contains the yellow toner as the first color toner. As a developing method, a jumping developing method, a nonmagnetic toner developing method or the like can be used, and image exposing and reversal developing are preferably used in combination. According to the embodiment, a developing method by a two-component developer is employed.

The visible first color toner image is electrostatically transferred (primary transfer) to a surface of an intermediate transferring member 7 on a first transferred portion 7*a* opposite the intermediate transferring member 7 as a rotary-driven second image bearer (image receiving member). The intermediate transferring member 7 is constituted of a conductive elastic layer and a mold-releasing surface layer, and has a peripheral length slightly longer than a maximum length of a recording medium to be conveyed. It is pressed into contact with the photosensitive member 2 by a predetermined pressing force, and rotary-driven at a circumferential speed roughly equal to that of the photosensitive member 2 in a direction reverse to a rotational direction of the photosensitive member 2 (i.e., in the same direction on a contact portion).

A voltage (primary transferring bias) of a polarity reverse to a toner charged polarity, is applied to a cylinder portion of the intermediate transferring member 7 by a high-voltage power source 7*c*, whereby a toner image is primary-transferred to the surface of the intermediate transferring member 7. Toner left on the surface of the photosensitive member 2 after the end of the primary transfer is removed by a later-described cleaner apparatus 8. Then, the above step is repeated for each color, whereby four-color toner images are transferred and superposed on the intermediate transferring member 7.

Recording media S are housed to be stacked in a cassette 9, separately fed one by one by a pickup roller 10, and subjected to skew feeding correction by a resist roller pair 11 to reach a transferred portion 7*b*. Then, a transferring belt 12 having been separated from the surface of the intermediate transferring member 7 is pressed into contact with the surface of the intermediate transferring member 7 by a predetermined pressing force, and rotary-driven. The transferring belt 12 is laid to be tense by a bias roller 12*a* and a tension roller 12*b*, and a voltage (secondary transferring bias) of a polarity reverse to the toner charged polarity is applied to the bias roller 12*a* by a high-voltage power source 12*c*.

Accordingly, toner images on the intermediate transferring member 7 are transferred en bloc (secondary transfer) to the surface of the recording medium conveyed to the second transferred portion 7*b* by a predetermined timing, then sent to fixing means 14 to receive heat and pressure to be fixed, and discharged to the outside of the machine by a discharging roller pair 15. Toner left on the surface of the intermediate transferring member 7 after the end of the secondary transfer is removed by an intermediate transferring member cleaning apparatus 13 which is brought into contact with the surface of the intermediate transferring member 7 by a predetermined timing.

Charging

The charging roller 3 as a flexible contact charging member which is charging means of the embodiment is constituted by forming a mid-resistance layer of rubber or foam on a core metal. The mid-resistance layer is prepared by a resin (urethane in the embodiment), conductive particles (e.g., carbon black), a sulphidizing agent, a foaming agent or the like, and formed in a roller shape on the core metal. Then, its surface is polished.

It is important that the charging roller 3 which is a contact charting member functions as an electrode. That is, it must have elasticity to obtain a sufficient contact state with a charged member (photosensitive member), and sufficiently low resistance simultaneously to charge the moving charged member. Additionally, it is advised to prevent voltage leakage when there is a low withstand pressure defective portion such as a pinhole on the charged member. In the case of using an electrophotographic photosensitive member as a charged member, resistance of $10^4$ to $10^7$ Ω is preferred to obtain sufficient charging performance and leakage resistance, and $10^6$ Ω is used in the embodiment.

If hardness of the charging roller 3 is too low, a shape becomes unstable to deteriorate contact performance with the charged member. If too high, not only a charging nip portion cannot be secured between the roller and the charged member but also microcontact performance with the surface of the charged member is deteriorated. Thus, 25° (degree) to 60° (degree) at Asker C hardness is a preferred range, and 50° is used in the embodiment. A material of the charging roller 3 is not limited to the elastic foam. As elastic materials, EPDM, urethane, NBR, silicon rubber, a rubber material in which a conductive substance such as carbon black or a metal oxide is dispersed in IR to adjust resistance, and foamed materials thereof are available. Without any particular dispersion of the conductive substance, resistance can be adjusted by using an ion conductive material.

The charging roller 3 is arranged so as to be pressed into contact with the photosensitive member 2 as the charged member by a pressing force of 2 kg against elasticity, and a charged portion of several mm in width is formed in the embodiment. A resistance value of the charging roller 3 is measured as follows. The photosensitive member 2 of the printer is replaced by an aluminum drum. Then, a voltage of 100 V is applied between the aluminum drum and the core metal of the charging roller 3. A current value flowing at this time is measured to obtain a resistance value of the charging roller 3.

The resistance value of the charging roller 3 of the embodiment thus obtained is $5\times10^6$ Ω. This resistance measurement is carried out under the environment of a temperature 25° C. and humidity 60%. The charging roller is rotated by being coupled with the rotation of the photosensitive member. The charging roller is subjected to constant-current control of a frequency 1.15 kHz and a total current of 1,750 μA from the charging high-voltage power source, and a photosensitive member potential is decided by a superposed DC bias.

Latent Image Formation

Figure 2:
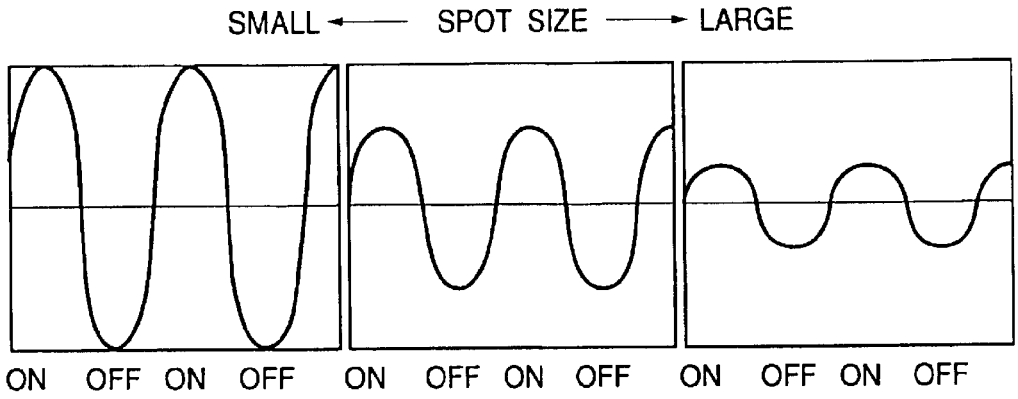
FIG. 2 is a view illustrating a relation between an image exposing spot size and a latent image contrast.

According to the aforementioned image forming method, a spot size of an image exposing light with which the photosensitive member is irradiated must be reduced in accordance with a recording density in order to carry out high-density recording according to the latent image formed on the photosensitive member. For example, if a gauss spot switched ON/OFF for each pixel is scanned, an exposure distribution on the photosensitive member is changed depending on a spot size (in a main scan) on the photosensitive member as shown in FIG. 2. That is, if a spot size is small, the exposure distribution of the image exposing light is similar to a rectangular wave which matches an ON/OFF timing, and a contrast is high. As a spot size is larger, the exposing light enters an adjacent pixel to reduce the exposure distribution and lower the contrast. Consequently, quality of an output image is deteriorated. Thus, in the case of forming an image of resolution 600 dpi (42 dot/mm$^2$), preferably, a spot size to form an image on the photosensitive member is set to 60 μm or lower (gauss distribution spot, $1/e^2$ diameter) to increase the contrast to 80% or more.

To carry out high-resolution recording, a ratio of a film thickness of a photoconductive layer (photosensitive layer) of the photosensitive member to resolution of an image to be recorded must be increased. If the ratio is small, a latent image is blurred by photocarrier diffusion, which makes it impossible to obtain a good image. Currently required resolution is 400 dpi or higher, more preferably 600 dpi or higher. A sum of film thicknesses of the photoconductive layer (photosensitive layer) and the surface (protective) layer which are used is 25 μm or lower, more preferably 20

μm or lower. A small film thickness of the photoconductive layer is preferable, but a film thickness of 1 μm or higher is desired because a pinhole at the same charging potential, a sensitivity reduction or the like occurs, more preferably 3 μm or higher.

A spot size of an optical beam is represented by a size in $1/e^2$ or more of the peak intensity (or energy), and used at 60 μm or lower. Use at 60 μm is undesirable because when an image signal of 400 dpi and 256 gray scales is supplied, an influence of overlapping with an adjacent image becomes large to make gradation reproducibility unstable.

Figure 3:
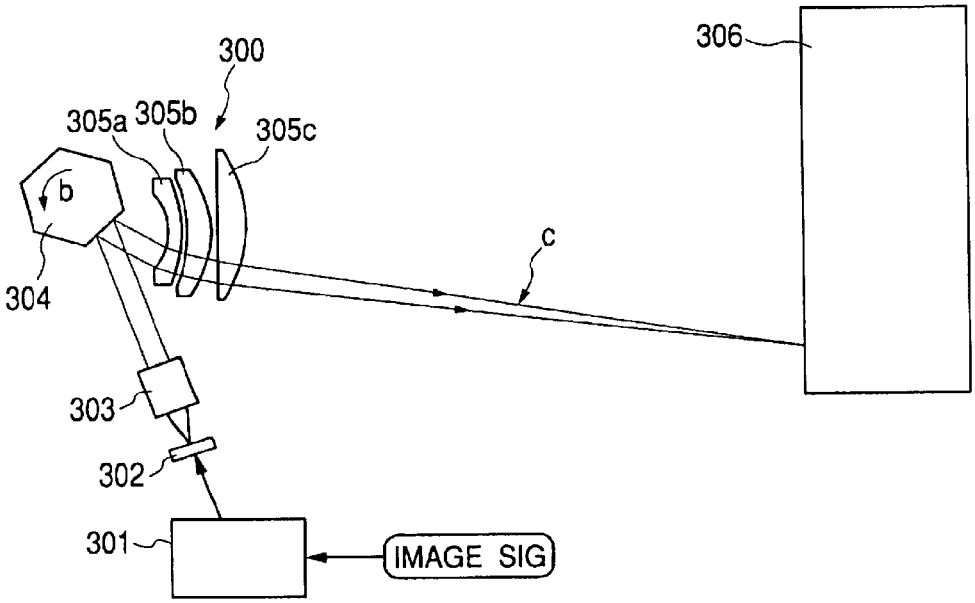
FIG. 3 is a schematic constitutional view of an image exposing apparatus used by the present invention.

FIG. 3 shows a schematic mechanism of a laser operation section 300 which is exposing means for scanning a laser beam in the electrophotographic image forming apparatus. In the case of scanning a laser beam by this laser operation section 300; first, based on an entered image signal, a laser beam emitted from a laser device 302 by a light emitting signal generator 301 is converted into roughly parallel luminous fluxes through a collimator lens system 303, scanned in an arrow direction c by a rotary polygon mirror 304 rotated in an arrow direction b, and an image is formed in a spot shape on a scanned surface 306 of the photosensitive drum (photosensitive member) or the like by an fθ lens group 305 constituted of lenses 305*a*, 305*b*, 305*c*.

By such laser beam scanning, an exposure distribution of one image scanning is formed on the scanned surface 306. If the scanned surface 306 is scrolled by a predetermined amount in a direction vertical to the scanning direction, an exposure distribution can be obtained on the scanned surface 306 in accordance with the image signal.

Photosensitive Member

Next, a description will be made of the surface protective layer of the photosensitive member of the present invention. The photosensitive member used in the embodiment is an electrophotographic photosensitive member in which at least the surface protective layer contains a polymerized or bridged, and cured compound. For the curing means, heat, a visible light, a light such as ultraviolet rays, and radioactive rays can be used. Accordingly, the means for forming the surface protective layer according to the embodiment employs a process of using a coating solution which contains a melted compound to be polymerized or bridged, and cured for the surface protective layer, and coating the solution by dipping coating, spray coating, curtain coating, spin coating or the like, and then curing it by the aforementioned curing means. The dipping coating method is best when photosensitive members are mass-produced efficiently, and the dipping coating method can be employed by the present invention.

A constitution of the photosensitive member according to the present invention is a single layer type of a layer structure which contains both of a charge generating substance and a charge transport substance on the same layer of the conductive substrate, or a laminate type in which a charge generating layer containing a charge generating substance and a charge transport layer containing a charge transport substance are laminated in this order or an opposite order. Further, the surface protective layer can be formed on the photosensitive layer. According to the embodiment, it is only necessary that at least the surface protective layer of the photosensitive member contains a compound to be polymerized or bridged, and cured by heat, a visible light, a light such as ultraviolet rays, or radioactive rays. However, in terms of characteristics of the photosensitive member, especially electrical characteristics such as a residual potential, and durability, the photosensitive constitution of a function separation type in which the charge generation layer and the charge transportation layer are laminated in this order, or the constitution in which the surface protective layer is formed on the photosensitive layer of such a laminated constitution is preferable.

According to the embodiment, for the curing method of the compound to be polymerized or bridged on the surface protective layer, radioactive rays are suitably used because there is no deterioration of the characteristics of the photosensitive member, no increase occurs in a residual potential, and sufficient hardness can be exhibited.

In this case, used radioactive rays are electron beams or gamma rays. In the case of irradiation with electron beams, accelerators of scanning, electron curtain, broad beam, pulse, laminar and other types can all be used. In the case of irradiation with electron beams, to achieve the electrical characteristics and durability of the photosensitive member of the embodiment, irradiation conditions include an acceleration voltage of 250 kV or lower preferably, 150 kV or lower optimally. The amount of irradiation is preferably in a range of 10 KGy to 1000 KGy, more preferably a range of 30 KGy to 500 KGy. If the acceleration voltage exceeds the above range, damage of electron beam irradiation for the characteristics of the photosensitive member tends to increase. Care must be taken because curing becomes insufficient if the amount of irradiation is smaller than the above range, and deterioration of the characteristics of the photosensitive member easily occurs if the amount of irradiation is large.

As the surface protective layer compound to be polymerized or bridged, and cured, compounds which have unsaturated polymeric function groups in molecules are preferable because of high reactivity, a fast reaction speed, and high hardness achieved after curing, especially those among them which have an acrylic group, methacrylic group and a styrene group.

According to the present invention, the compound which has the unsaturated polymeric function group is largely classified into a monomer and an oligomer depending on repetition of a constitutional unit. The monomer is a compound of no repetition of a constitutional unit which has an unsaturated polymeric function group and of relatively small molecular weight, while the oligomer is a polymer in which the number of repetitions of a constitutional unit having an unsaturated polymer function group is about 2 to 20. Additionally, a macromonomer which has an unsaturated polymeric function group only at a tail end of the polymer or oligomer can be used as a curable compound for the surface layer of the present invention.

Further preferably, the compound which has the unsaturated polymer function group is the embodiment is a charge transport compound is order to satisfy a charge transport function necessary as the surface protective layer. Among others, an unsaturated polymeric compound which has a hole transport function is particularly preferable.

Next, a description will be made of the photosensitive layer of the electrophotographic photosensitive member of the present invention. As a support of the electrophotographic photosensitive member, any kinds are used as long as they are conductive. For example, there are available a support in which metal or alloy such as an aluminum, copper, chromium, nickel, zinc, or stainless in a drum or sheet shape, a support in which a metal foil of aluminum, copper or the like is laminated on a plastic film, a support in which aluminum, a yttrium oxide, a tin oxide or the like is deposited on a plastic film, and a metal, a plastic film, paper or the like in which a conductive substance is coated singly or with a binding resin to dispose a conductive layer.

According to the embodiment, an undercoating layer which has a barrier function and a bonding function can be disposed on the conductive support. The undercoating layer is formed so as to improve adhesion of the photosensitive layer, improve coating performance, protect the support, cover a defect on the support, improve charge injection performance from the support, and give protection against electrical destruction of the photosensitive layer, etc. As materials of the undercoating layer, there are available polyvinyl alcohol, poly-N-vinylimidazole, polyethylene oxido, ethyl cellulose, ethylene-acrylic acid copolymer, casein, polyamide, N-methoxymethylate 6 nylon, copolymer nylon, glue, gelatin, etc. These are dissolved in proper solvents to be coated on the support. In this case, a preferred film thickness is 0.1 to 2 $\mu$m.

If the photosensitive member is a function separation type, the charge generating layer and the charge transport layer are laminated. As a charge generating substance used for the charge generating layer, there can be cited selenium-tellurium, pyrylium, thiapyrylium-based dyes, various central metals and crystal systems, specifically, for example, phthalocyanine-based compounds which have crystal forms such as $\alpha$, $\beta$, $\gamma$, $\epsilon$ and X forms, anthoanthrone pigments, dibenzpyrenequinone pigments, pyranethroron pigments, trisazo pigments, disazo pigments, monoazo pigments, indigo pigments, quinacridone pigments, asymmetrical quinocyanine pigments, quinocyanine, amorphous silicon described in Japanese Patent Application Laid-Open No. 54-143645, etc.

In the case of the photosensitive member of the function separation type, the charge generating layer is formed by dispersing the charge generating substance together with a binding resin of which mass is 0.3 to 4 times as much as that thereof and a solvent well by means such as a homogenizer, ultrasonic dispersion, a ball mill, a vibration ball mill, a sand mill, an attritor, a roll mill or the like, coating dispersion liquid and drying it, or formed as a film of single composition such as a deposition layer of the charging generation substance. Its film thickness is preferably 5 $\mu$m or lower, especially preferably in a range of 0.1 to 2 $\mu$m.

As examples of using the binding resin, there can be cited a polymer and a copolymer of vinyl compounds such as styrene, vinyl acetate, vinyl chloride, acrylic acid ester, methacrylic acid ester, vinylidene fluoride, and trifluoroethylene, polyvinyl alcohol, polyvinyl acetal, polycarbonate, polyester, polysulfone, polyphenylene oxide, polyurethane, and cellulose resins, a phenol resin, a melanine resin, a silicon resin, an epoxy resin, etc.

According to the embodiment, the hole transport compound which has the unsaturated polymeric function group can be used as a charge transport layer on the charge generating layer, or as a surface protective layer after a charge transport layer, and a charge transport layer made of a binding resin are formed on the charge generating layer.

In the case of use as the surface protective layer, the charge transport layer which is its underlayer can be formed by using the before-mentioned well-known method to coat and dry a solution, which is prepared by dispersing/dissolving, in a solvent, a proper charge transport substance, e.g., a high molecular compound which has a heterocyclic or condensed polycyclic aromatic group such as poly-N-vinylcarbazole or polystylanthracene, a heterocyclic compound such as pyrazoline, imidazole, oxazole, triazole, or carbazole, or a low molecular compound such as a triarylamine derivative, such as triphenylamine, a phenylenediamine derivative, an N-phenylcarbazole derivative, a stilbene derivative, or hydrazone derivative, together with a proper binding resin (it can be selected from the aforementioned charge generating layer resins).

For a ratio of the charge transport substance to the binding resin in this case, desired mass of the charge transport substance is 30 to 100 when total mass of both is 100 and, preferably selected properly from a range of 50 to 100. If the amount of the charge transport layer is less this range, a charge transport ability is reduced, creating problems of a sensitivity reduction, a residual potential increase, etc. In this case, a thickness of the photosensitive layer is in a range of 5 to 25 $\mu$m. This film thickness of the photosensitive layer at this time is a total of film thicknesses of the charge generating layer, the charge transport layer and the surface protective layer.

In any case, in the method of forming the surface protective layer, generally, polymerization/curing reaction is carried out after the solution which contains the hole transport compound is coated. However, the surface protective layer can be formed by first reacting the solution which contains the hole transport compound to obtain a cured object, and then dispersing or dissolving it again in the solvent. As methods of coating such solutions, there are known a dipping coating method, a spray coating method, a curtain coating method, a spin coating method etc., and the dipping coating method is preferable from the standpoint of efficiency/productivity. Other well-known film forming methods such as deposition or plasma can be selected as occasion demands.

According to the embodiment, conductive particles may be mixed in the surface protective layer. As conductive particles, a metal, a metal oxide, carbon black, etc. can be cited. For the metal, there are available aluminum, zinc, copper, chromium, nickel, stainless, silver, etc. and a member in which such metals are deposited on the surface of plastic particles, are available. For the metal oxide, there are available a zinc oxide, a titanium oxide, a tin oxide, an antimony oxide, an indium oxide, a bismuth oxide, an indium oxide in which tin is doped, a tin oxide in which antimony is doped, a zirconium oxide in which antimony is doped, etc. These can be used singly or in combination of two or more. In the case of combination of two or more, they may be simply mixed, or formed in a solid solution or melted.

An average particle diameter of the conductive particles used by the embodiment is preferably 0.3 $\mu$m or lower for transparency of the protective layer, especially 0.1 $\mu$m or lower. According to the present invention, use of the metal oxide among the conductive particles is particularly preferable for transparency or the like. A ratio of conductive metal oxide particles in the surface protective layer is one of the factors to directly decide resistance of the surface protective layer, and resistance of the protective layer is preferably set in a range of $10^{10}$ to $10^{15}$ $\Omega\cdot$cm.

According to the embodiment, fluorine atom containing resin particles can be contained in the surface protective layer. For the fluorine atom containing resin particles, preferably, one, two or more are properly selected from a 4-fluroroethylene resin, a 3-fluorochlorine ethylene resin, a 6-fluoroethylene propylene resin, a fluorovinyl resin, a fluorovinylidiene resin, a 2-fluoro 2-chlorine ethylene resin, and a copolymer thereof, and especially the 4-fluroethylene resin and the fluorovinylidiene resin are preferable. Molecular weight and particle diameters of the resin particles can be selected as occasion demands, and there is no particular limitation.

A ratio of the fluorine atom containing resin particles in the surface protective layer is preferably 5 to 70 mass % with respect to total mass of the surface protective layer, more preferably 10 to 60 mass %. If the ratio of the fluorine atom containing resin is larger than 70 mass %, mechanical strength of the surface protective layer tends to be reduced. If the ratio of the fluorine atom containing resin particles is lower than 5 mass %, mold releasing of the surface of the surface protective layer, wear resistance of the surface protection layer, damage resistance may not be sufficient.

According to the embodiment, to further improve dispersion, binding and weather resistance, additives such as radical scavengers or antioxidants may be added in the surface protective layer. A film thickness of the surface protective layer is preferably set in a range of 0.2 to 10 $\mu$m, more preferably a range of 0.5 to 6 $\mu$m.

Cleaning Apparatus

Next, the cleaning apparatus 8 of the embodiment will be described by referring to FIG. 4. The cleaning apparatus 8 comprises a cleaning blade 8*a* supported by a sheet metal 8*f*, a toner collection sheet 8*b*, a waste toner recovery container 8*c*, a cleaning brush 8*d*, a brush scraper 8*e* which is a scraper member, etc.

As described above, the toner left on the surface of the photosensitive member 2 after the end of the primary transfer is removed from the photosensitive member 2 by the cleaning blade 8*a* and the cleaning brush 8*d* which constitute the cleaning apparatus 8, and stored in the waste toner recovery container 8*c* by the waste toner collection sheet 8*b* without being scattered to the outside of the cleaning apparatus 8.

The cleaning brush 8*d* is formed in a brush shape of $\phi$16 (mm) by planting a conductive fiber in foundation cloth and winding it on a core metal 8*h* of $\phi$6 (mm), and the core metal 8*h* is grounded. According to the embodiment, for the conductive fiber (its resistance is about $10^5$ $\Omega$ at the time of 50 V application), a nylon conductive thread of a weaving degree $4.4\times10^{-7}$ (kg/m) is used. A fiber planted in foundation cloth by W weaving to achieve a fiber density 93 number/mm$^2$ (lines/mm$^2$) is formed in a sheet shape, and spirally wound so as to secure conduction with the core metal 8*h*.

The cleaning brush 8*d* is arranged on the upstream side of the cleaning blade 8*a* in the rotational direction of the photosensitive member 2, abutted by the incursion amount of 1 mm with respect to the photosensitive member 2, rotatably disposed, and rotary-driven in an arrow direction B similar to the rotational direction of the photosensitive member 2 at a speed of 30 rpm (i.e., the photosensitive member 2 and the cleaning brush 8*d* are moved in opposing directions on a contact portion). On the contact portion, scraping-off of the transfer residual toner on the photosensitive member 2 after the primary transfer, or cleaning by the later-described cleaning blade 8*a* is facilitated by reducing an adhesive force of the transfer residual toner to the photosensitive member 2.

On the other hand, the cleaning blade 8*a* is made of polyurethane rubber integrally held on the tip of the sheet metal 8*f*, and abutted on the photosensitive drum (photosensitive member) 2 by a linear load (line pressure) of 20 N/m or higher to 65 N/m or lower. It is because toner sneaking-through occurs at a linear load lower than 20 N/m while reversal of the cleaning blade 8*a* occurs at a load larger than 65 N/m. The residual toner scraped off by the cleaning blade 8*a* is sent to the cleaning container. The cleaning blade 8*a* is an elastic blade mainly made of urethane. Hardness of the cleaning blade 8*a* is 77° (JIS A). The cleaning blade 8*a* is abutted on the photosensitive drum 2 by an abutting angle 24°. A plate thickness of the cleaning blade is 2.0 mm.

Developer

A developer used for the image forming method of the embodiment is a two-component developer which is a mixture of nonmagnetic toner and a resin magnetic carrier. A T/D ratio of the developer is 8%. For the resin magnetic carrier, a carrier in which the amount of magnetization in magnetism of 1 kOe is 100 emu/cm$^3$, a number average particle diameter is 40 $\mu$m, and specific resistance is $10^{13}$ $\Omega$·cm is used.

Shape sphericity of the toner particles is represented by using shape coefficients SF-1 and SF-2 calculated from the following equation (1). The toner shape factors (shape coefficients) SF-1 and SF-2 are calculated by using FE-SEM (S-800) of Hitachi, Ltd., to sample 100 toner images at random, analyzing image information thereof by an image analyzing apparatus (Luzex 3) of Nireco Corporation, and based on the following equation (1):

$$SF\text{-}1=\{(MXLNG)^2/\mathrm{AREA}\}\times(4/\pi)\times100$$

$$SF\text{-}2=\{(PERI)^2/\mathrm{AREA}\}\times\{1/(4\pi)\}\times100 \quad (1)$$

(AREA: toner projected area, MXLNG: absolute maximum length, PERI: peripheral length)

The SAF-1 of the toner shape factors indicates sphericity. Toner is truly spherical when the SF-1 is 100, while toner is roughly spherical when the SF-1 is 100 to 150. If the SF-1 is larger than 150, the toner gradually becomes indefinite from the rough spherical shape. The shape factor SF-2 indicates irregularity on the surface of the toner particles. The toner surface is smooth when the SF-2 is 100 to 140, while an irregular shape on the toner surface becomes conspicuous when the SF-2 is larger than 140. As the toner used for the image forming apparatus of the embodiment, roughly spherical toner in which a volume average particle diameter is 5 $\mu$m or higher to 8 $\mu$m or lower, the shape factor SF-1 is 100 to 150, and the SF-2 is 100 to 140 is preferable in order to maintain stable cleaning, high image quality and high transfer efficiency. When the SF-1 exceeds 150 or the SF-2 exceeds 140, it is unfavorable because the sphericity or the surface irregular shape of the toner is increased, adhesion to the photosensitive drum is increased to enlarge a load on the cleaning blade, and consequently the cleaning blade tends to vibrate.

For the toner particle diameter, if the volume average particle diameter is less than 5 $\mu$m, handling of powders becomes very difficult, and sneaking-through or the like becomes hard. On the other hand, if the volume average particle diameter exceeds 8 $\mu$m, a toner micropowder component supplied to a blocking layer which is made of additives and a toner micropowder component and formed on the cleaning nip portion to secure cleaning stability is reduced. Consequently, cleaning may become unstable easily.

The toner volume average particle diameter is measured by using Coulter Multisizer II (by Coulter Corporation). An interface (Nikka Machinery. Ltd.) and a PC 9801 personal computer (NEC) which output a number distribution and a volume distribution are connected to the Coulter Multisizer II, and a 1% NaCl aqueous solution is prepared by using a 1st-class sodium chloride. For example, ISOTON R-II (Coulter Scientific Japan, Corporation) can be used. As a measuring method, a surfactant (surface active agent), preferably alkylbenzene sulfonate, is added as a dispersant by 0.1 to 5 ml in the electrolytic aqueous solution 100 to 150 ml, and a measured sample is added by 2 to 20 mg. The electrolytic solution in which the sample suspended is subjected to dispersion by an ultrasonic disperser for about 1 to 3 min. By the Coulter Multisizer II, the volume and the number of toner of 2 μm or more are measured to calculate a volume distribution and a number distribution by using a 100 μm aperture as an aperture.

There is no particular limitation on the toner production method of the present invention. However, to produce spherical toner, preferably, toner is produced by a suspension polymerization method, a mechanical crushing method, spheroidization, etc., particularly the suspension polymerization is preferable.

Particle size distribution control or particle diameter control of toner in the suspension polymerization method can be carried out by pH adjustment of a system at the time of granulation, a method for changing a kind or an added amount of hard water soluble inorganic salts or a dispersant which has a protective colloid operation, and controlling mechanical apparatus conditions, e.g., agitation conditions including a circumferential speed of a rotor, the number of passing times, an agitation blade shape, etc., a container shape or solid portion concentration in the aqueous solution.

Since toner produced by a crushing method can be used as a developer of the present invention, toner production by the crushing method will be described.

For the crushing method toner of the embodiment, a binding resin, a release agent, a charge control agent, a colorant or the like is sufficiently mixed by a mixer such as Henschel mixer or a ball mill, then melted and kneaded by a heat kneading machine such as a heating roll, a kneader or an extruder, the charge control agent or the colorant is dispersed or dissolved in a mutual solvent of resins, cooled to be solidified, then mechanically crushed into micropowders to achieve a desired particle size, and a particle size distribution is made sharp by classification. Alternatively, after the cooling for solidification, micropowders obtained by clashing with a target under a jet air flow is made spherical by heat or a mechanical impact force.

For spheroidization by a mechanical impact force or heating, there are a method for pressing, by a centrifugal force, toner to the inside of a casing by a blade which is rotated at a high speed, and applying a mechanical impact force to the toner by a compression force/frictional force, e.g., Mechanofusion System by Hosokawa Micron, Ltd., or Hybridization System by Nara Machinery, Ltd., a method for melting a toner surface, e.g., Surfusion System by Nihon Newmatic, Ltd., etc.

Furthermore, according to the embodiment, silica, a titanium oxide or the like is added in order to improve developing performance, transferring performance, cleaning performance and durability, and inorganic polished particles of Mohs hardness 5.0 or higher are added as additives. As such polished particles, there are strontium titanate (Mohs hardness 5), born carbide (Mohs hardness 14), silicon carbide (Mohs hardness 13), titanium carbide (Mohs hardness 13), aluminum oxide (Mohs hardness 12), sapphire (Mohs hardness 12), ruby (Mohs hardness 12), diamond (Mohs hardness 15), corundum (Mohs hardness 12), etc.

For the toner used in the image forming method of the embodiment, compared with the conventional infinite form toner, self-lubricity is high because of high sphericity and no variance in size. Thus, the toner easily sneaks through from the abutting portion of the cleaning blade 8*a*, and cleaning failures easily occur.

Relation Between 1 Pixel Area and Fur Brush Density

Next, the features of the present invention will be described.

As described above, the inventors carried out image formation at resolution of 200 dpi. During the formation, the inventors interrupted the forming operation to observe a toner behavior in cleaning, and discovered regularity in a state on the photosensitive drum before the cleaning, i.e., in a pattern of transfer residual toner. Thus, the pattern was investigated to find the transfer residual toner had an interval of its integral multiple from another while a section of about 130 μm was a minimum unit. This value 130 μm approximately coincides with a pixel size 25.4 mm/200=127 μm of 200 dpi of image formation. Then, as resolution of latent image formation was changed, a presence pattern of the transfer residual toner was investigated. It was verified that a size of a latent image pixel approximately coincided with the transfer residual pattern.

1 pixel area S of the present invention is defined not as an image exposing spot area but a square in which a length of 1 pixel is one side. That is, at 200 dpi, 1 pixel area becomes $S=(25.4\ \text{mm}/200)^2=1.6\times10^{-2}\ (\text{Dot/mm}^2)$.

If an image is formed at resolution equivalent to dpi, as described above, for example at 600 dpi, it is image formation in which a 25.4 mm width is divided into 600. Thus, 1 pixel area S becomes $S=(25.4\ \text{mm}/600)^2$.

However, in the case of forming a latent image by using a dither matrix or the like, for example, when an image is formed at 1200 dpi in which 4 dots constitute one dot, how to collect toner which is developed to form and develop a latent image for each image formation minimum unit of 4 dots, i.e., how the transfer residual toner is left, is distributed in accordance with the minimum unit, and thus 1 pixel area S becomes $S=(25.4/(1200/4))^2$.

Figure 6:
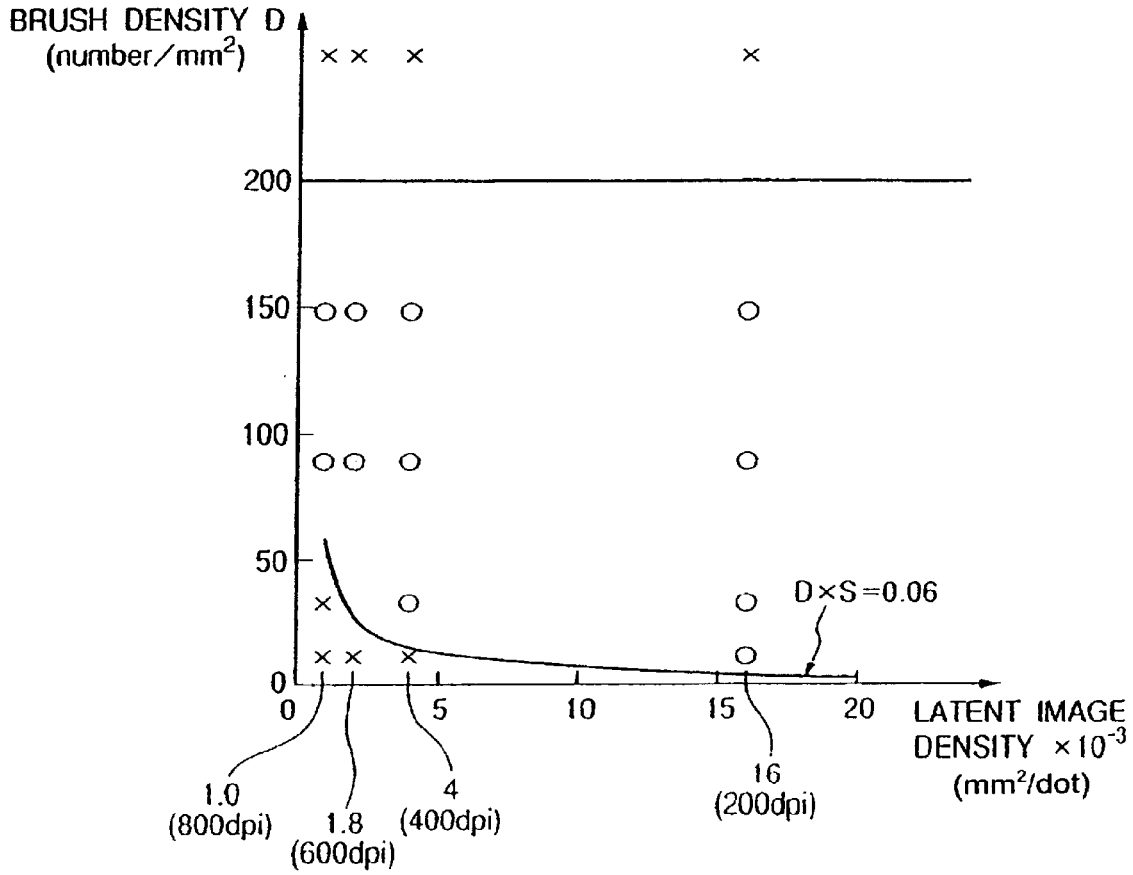
FIG. 6 is a graph showing a cleaning result based on a latent image density S and a brush density D of a first embodiment.

FIG. 6 shows a result of an experiment of passing 10000 sheets which is made by changing 1 pixel area S of a latent image and a fiber brush density D of the fur brush in order to effectively clean the transfer residual toner.

In the drawing, a mark ○ indicates execution of good image formation without any cleaning failures in the experiment of passing 10000 sheets, while a mark ×indicates formation of an image of sneaking-through or the like during the experiment. The followings can be understood from the result.

(1) For a lower limit of an area in which cleaning is good, a brush density D (number/mm$^2$) must be drastically increased as 1 pixel area S (mm$^{2/dot}$) becomes smaller. It is appreciated that this is attributed to a synergy effect that a brush density D which matches a size of a pixel becomes necessary as 1 pixel area S becomes smaller and, simultaneously, a depth of a latent image potential becomes deeper as 1 pixel area S becomes smaller, and toner is stuck more firmly to the surface of the photosensitive drum. The lower limit of the area of good cleaning of FIG. 6 was investigated to find that a boundary was around a product of 1 pixel area S and the brush density D, $S\times D=0.06$. That is, 1 pixel area S and the brush density D are inversely proportional to each other.

(2) An upper limit on area of good cleaning is present at around a brush density (number/mm$^2$) of 200 (number/mm$^2$) irrespective of 1 pixel area S. It is because when a cleaning brush density in which a brush density D exceeds 200 (200 number/mm$^2$) is set, a fiber of the brush itself becomes thin to lower a scraping ability.

As described above, if a brush density is D (number/mm$^2$) and 1 pixel are of a digital latent image is S (mm$^2$/dot), by setting $D\times S\geqq0.06$ and $D\leqq200$, good image formation of no cleaning failures or the like is carried out.

As brush conditions, various materials such as nylon, rayon, polyester, and an acrylic material can be used. A weaving degree of the brush is preferably $\geqq0.3\times10^{-6}$ kg/m or higher to $2.2\times10^{-6}$ kg/m or lower, more preferably $0.4\times10^{-6}$ kg/m or higher to $1.1\times10^{-6}$ kg/m or lower in this range.

Figure 4:
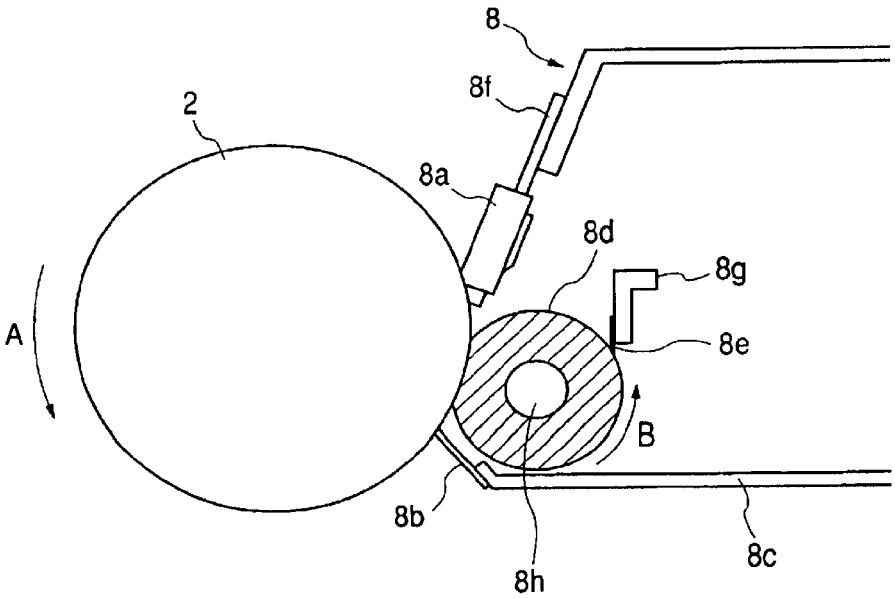
FIG. 4 is a schematic constitutional sectional view of a preferred cleaner apparatus of the present invention.
Figure 5:
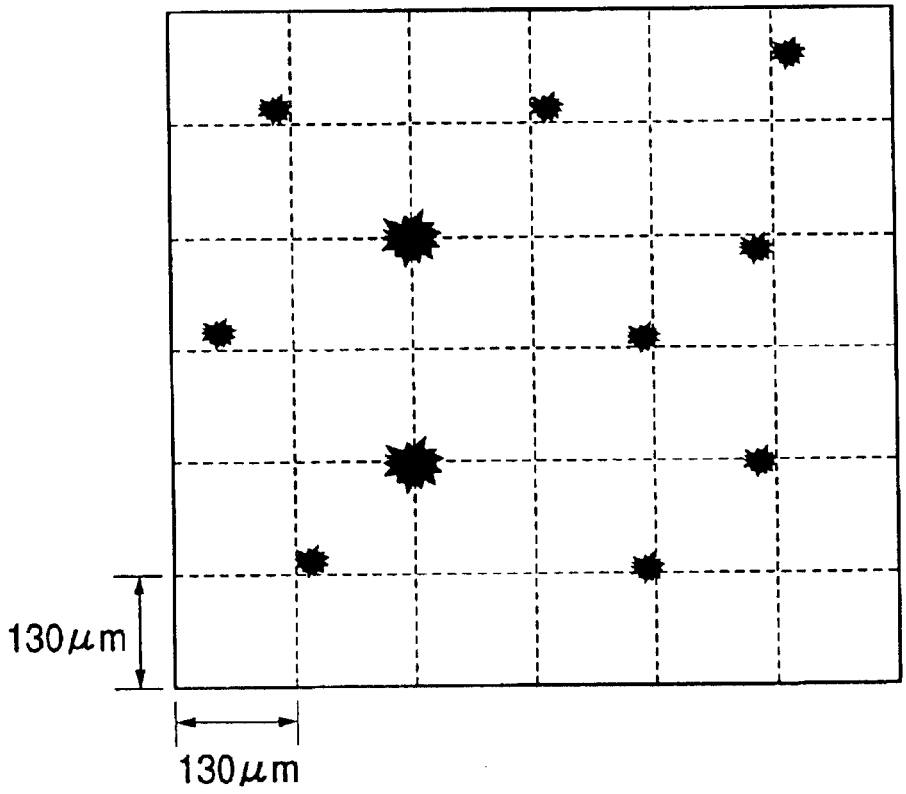
FIG. 5 is a view of observing a state of transfer residual toner.

A fiber density D of the brush is typically set to 15.5 number/mm$^2$ or higher, preferably 46.5 or higher to 155 number/mm$^2$ or lower According to the embodiment shown in FIG. 4, for the brush scraper 8*e*, for example, a flexible sheet made of polyethylene terephthalate (PET) of 0.1 mm in thickness is stuck to a sheet metal 8*g*, its free length is set to 2 mm, and the incursion amount β of the scraper with respect to the cleaning brush 8*d* is set to 1.0 mm.

Especially, in the case of using a photosensitive member of high wear resistance on the surface, since the surface is not scraped by the cleaning blade, an effect of scraping off a foreign object stuck to the surface of the photosensitive member for refreshing is reduced. Consequently, deterioration of the surface of the photosensitive member progresses for a long time. Since the deterioration of the surface of the photosensitive member reduces sliding performance on the surface of the photosensitive member, especially sliding performance of the cleaning blade, chattering or curling-up of the blade easily occurs. In order to prevent such chattering or curling-up of the blade, preferably, toner is coated on the photosensitive member by the cleaning brush.

The inventors conducted earnest studies by paying attention to a relation between the incursion amount α of the brush with respect to the photosensitive member 2 and the incursion amount β of the scraper with respect to the cleaning brush, and discovered that a relation which satisfied $\alpha \geqq \beta$ was preferable.

That is, when the incursion amount β of the brush with respect to the brush scraper 8*e* becomes larger than the incursion amount α of the brush with respect to the photosensitive member 2, a scraping-off operation on the brush by the scraper becomes too strong. Consequently, it is difficult to secure a sufficient toner coating amount on the photosensitive member 2.

While it depends on a material, a thickness and a free length of the scraper, curling-up may occur because of durability if the incursion amount β is set too large. Further, if a scraping operation is too strong, there is a possibility that a sufficient coating amount will not be secured on the image bearer.

According to a result of investigation by the inventors, it is advised to set the incursion amount β smaller than 2.5 mm in order to prevent curling-up.

Second Embodiment

As preferred image forming method and apparatus of the embodiment, a photosensitive member of a photoconductive layer (photosensitive layer) made of a non-single crystal material in which a silicon atom is a matrix, i.e., an amorphous silicon photosensitive member, is used as an electrophotographic photosensitive member. The amorphous silicon member is suitably used to achieve high durability and a long life because of its high wear resistance and limited changes in electrical characteristics (especially E-V characteristics) with passage of time. For the method and the apparatus of the embodiment for image formation, description of portions similar to those of the first embodiment is omitted. An outer dimension, a shape etc., of the photosensitive member are also similar to those of the first embodiment.

Photosensitive Member

Figure 7A:
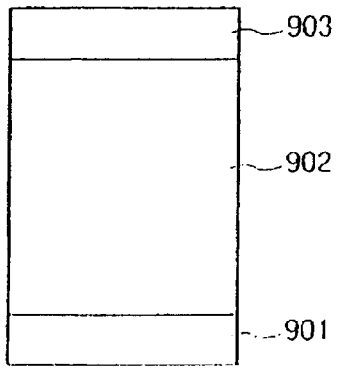
FIGS. 7A and 7B are views illustrating a layer constitution of an amorphous silicon drum of a second embodiment.
Figure 7B:
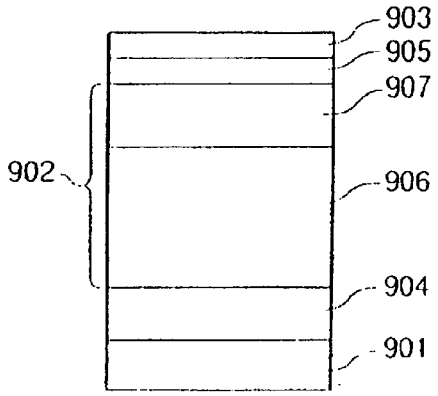

FIGS. 7A and 7B show an example of an electrophotographic photosensitive member of the present invention. The electrophotographic photosensitive member of the embodiment is constituted by, for example, sequentially laminating a photoconductive layer 902 and a surface protective layer 903 on a substrate 901 made of an Al or stainless conductive material (see FIG. 7A). In addition to these layers, various function layers including a lower charge injection blocking layer 904, an upper charge injection blocking layer 905, a charge injection layer, a reflection prevention layer, etc., may be disposed. For example, the lower charge injection blocking layer 904, the upper charge injection blocking layer 905, etc., are disposed, and dopants thereof are selected from III-group elements, V-group elements etc., whereby charging polarities such as positive charging and negative charging can be controlled (see FIG. 7B).

The substrate may be formed in a desired shape in accordance with a driving system or the like of the electrophotographic photosensitive member. As a material of the substrate, an Al or stainless conductive material similar to the above is general. However, various materials which are not conductive, e.g., plastics, ceramics, etc., can be used by depositing the above conductive materials thereon.

For the photoconductive layer 902, for example, amorphous materials containing silicon atoms, hydrogen atoms or halogen atoms (abbreviated to "a-Si (H, X)") are representatives. For a layer thickness of the photoconductive layer 902, 20 μm or lower is proper when conditions to enable formation of a high-resolution latent image, manufacturing costs, etc., are considered.

Further, in order to improve characteristics, a constitution of a plurality of layers such as a lower photoconductive layer 906 and an upper photoconductive layer 907 may be employed (see FIG. 7B). Especially, for a light source such as a semiconductor laser in which a wavelength is relatively long, and there is almost no variance in wavelength, surprising effects may be exhibited by such contrivance of a layer constitution. Additionally, the surface protective layer 903 can also serve as a charge injection layer for charging.

An interface between the photoconductive layer 902 and the surface protective layer 903 may be continuously changed, and a reflection prevention layer may be disposed to suppress interface reflection thereon. By using a photosensitive member similar to the above, the inventors conducted an experiment of passing 10000 sheets in which for example a binary latent image was formed at resolution of 600 dpi (S=1.8×0–3 mm$^2$/dot), a polyester fiber treated to be conductive was used for a fur brush, and S×D=0.17 was set while a weaving degree was $1.1\times10^{-6}$ (kg/mm) and a density D was D=93 (number/mm$^2$). No cleaning failures occurs, and high-quality image formation was stably carried out.

Third Embodiment

The embodiment is different from the first embodiment in the following points. That is, a process speed is 400 mm/sec., a rotational direction of a fur brush is similar to the nip of the photosensitive drum, and it rotational speed is set to 100 rpm.

The inventors conducted an experiment of passing 100 thousand sheets in which at the above setting, resolution was set to 800 dpi, i.e., 1 pixel area $S=1.0\times10^{-3}$ (mm$^2$/dot) was set, a brush density was set to D=186 (number/mm$^2$), S×D=0.186 was set, and a thickness of a brush fiber was changed to 10 to 50 μm. Table 1 shows a result of the experiment.

TABLE 1

| Brush thickness (μm) | 15 | 20 | 30 | 50 | 65 | 80 |
|---|---|---|---|---|---|---|
| Result of sheet passage | X | ○ | ○ | ○ | X | X |

Thus, even if $D\times S \geqq 0.06$ which is a product of the cleaning density D and 1 pixel area S, and $D \leqq 200$ are satisfied, according to the embodiment, at a high speed and at high resolution, a brush thickness is preferably set in a range of 20 to 50 μm, more preferably 25 to 35 μm.

It is because if the brush thickness is less than 20 μm, a brush fiber becomes too thin, and a sufficient scraping effect can not be exhibited. On the other hand, if the brush thickness exceeds 50 μm, a brush fiber becomes too hard, and the surface of the photosensitive member is damaged. Consequently, the toner sneaks through the damaged portion to cause cleaning failures.

As described above, by optimizing 1 pixel area and the cleaning brush density D, cleaning can be stably carried out for the high-density image formed on the thin-film photosensitive member (sum of the photosensitive layer and the surface layer is 25 μm or lower). For the purpose of further assisting the cleaning brush effects, it is effective to actively recoat the transfer residual toner and cleaner-recovered toner on the surface of the photosensitive drum or the cleaning brush, and to inject toner in the cleaning brush beforehand while the apparatus is still new. A lubricant may be carried by the cleaning brush from the new state of the apparatus, and the lubricant may be supplied to the photosensitive member by the cleaning brush. Accordingly, since the surface of the photosensitive member becomes smooth, chattering or curling-up of the cleaning blade can be prevented. For the lubricant, silica, a titanium oxide, etc., may be mixed as additives in the toner. Preferably, 5 to 20 wt % (part by weight) of additives are mixed in toner 100 wt %.

A primary particle diameter of the additives contained in the lubricant is preferably 10 to 100 nm. If a particle diameter is less than 10, the number of components which sneak through the cleaning blade becomes too large, which makes it impossible to stably form a blocking layer. If abutting pressure of the cleaning blade on the photosensitive member is increased so as to regulate the passage of additive particles of 10 nm or less at this time, deterioration of the cleaning blade is promoted, and consequently a satisfactory life as a cleaning system cannot be obtained.

Conversely, if an additive particle diameter is larger than 100 nm, the number of components which sneak through is reduced, creating a state of easy chattering occurrence. If abutting pressure of the cleaning blade on the photosensitive member is lowered so as to pass additives of 100 nm or larger at this time, even the toner to be blocked sneaks through. In the case of the spherical polymeric toner of the first embodiment, compared with the crushed toner, the toner itself sneaks through easily, and thus the direction becomes harder.

In the embodiments, the photosensitive drum is used for the photosensitive member. However, a photosensitive belt can be used. In place of exposure of the photosensitive member with the laser beam, exposure can be carried out by using an LED array. As an image receiving member which receives a developer image from the photosensitive member, a transferring material such as paper can be used in place of the intermediate transferring member. In the case of forming a color image, the transferring material may be conveyed by a transferring material conveying member such as a transferring drum or a transferring belt.

Without disposing the cleaning blade, the photosensitive member may be cleaned only by the cleaning brush.

Furthermore, the present invention is not limited to the foregoing image forming apparatus and the image forming method. Needless to say, the invention can be applied to well-known image forming means and apparatus, and various applications are possible.

As described above, in the image forming method for forming an image by using the photosensitive member in which a sum of the thickness of the photosensitive layer and the thickness of is 25 μm or lower, charging the photosensitive member by the charging means, developing the digital latent image formed by the exposing light modulated in accordance with the image information on the charged photosensitive member by the developing means, transferring the developed toner image, and cleaning the photosensitive member by the cleaning after the transfer, the brush is disposed to be brought into contact with the photosensitive member, and $D \times S \geqq 0.06$ and $D \leqq 200$ are set when the brush density is D (number/mm$^2$) and 1 pixel area of the digital latent image is S (mm$^2$/dot). Thus, the transfer residual toner on the photosensitive member is uniformly scraped off, and dispersed to improve stability of cleaning, and stable image formation can be carried out without any cleaning failures for a long time.

What is claimed is:

1. An electrophotographic apparatus comprising:

a photosensitive member which comprises a surface layer formed on a surface thereof and a photosensitive layer, wherein a sum of a thickness of the photosensitive layer and a thickness of the surface layer is 25 μm or lower;

exposing means for exposing the photosensitive member in accordance with a digital image signal in order to form an electrostatic image of 400 dpi or higher on the photosensitive member;

developing means for forming a developer image on the photosensitive member by developing the electrostatic image by a developer; and cleaning means for cleaning a residual developer from the photosensitive member after the developer image is transferred to an image receiving member, which comprises a cleaning brush brought into contact with the photosensitive member, wherein a brush density of the cleaning brush is represented by D (number/mm$^2$), an area of a pixel of the electrostatic image is represented by S (mm$^2$/dot), and $D \times S \geqq 0.06$ and $D \leqq 200$ are satisfied.

2. The electrophotographic apparatus according to claim 1, wherein the cleaning means further comprises a cleaning blade for removing the residual developer from the photosensitive member on a downstream side of the cleaning brush in a moving direction of the photosensitive member.

3. The electrophotographic apparatus according to claim 1, wherein the surface layer contains a compound obtained by polymerizing or bridging, and curing a compound which has an unsaturated polymeric functional group or a hole transport compound.

4. The electrophotographic apparatus according to claim 1, wherein the photosensitive layer comprises a non-single crystal material in which a silicon atom is a matrix.

5. The electrophotographic apparatus according to claim 1, wherein a thickness of a fiber of the cleaning brush is 20 to 50 μm.

6. The electrophotographic apparatus according to claim 1, wherein the developer comprises toner, a shape factor SF-1 of the toner is 100 to 150, a shape factor SF-2 thereof is 100 to 140, and a volume average particle diameter thereof is 5 to 8 μm.

7. The electrophotographic apparatus according to claim 1, wherein the exposing means irradiates the photosensitive member with a laser beam.

8. The electrophotographic apparatus according to claim 1, wherein the sum of the thickness of the photosensitive layer and the thickness of the surface layer is 20 $\mu$m or lower.

9. The electrophotographic apparatus according to claim 1, wherein the brush density D (number/mm$^2$) satisfies $D \geqq 15.5$.

10. The electrophotographic apparatus according to claim 1, wherein the cleaning brush comprises a brush fiber in which a weaving degree is $0.3\times10^{-6}$ kg/m to $2.2\times10^{-6}$ kg/m.

11. The electrophotographic apparatus according to claim 1, the cleaning brush supplies a lubricant to an image bearer.

12. The electrophotographic apparatus according to claim 1 or 11, further comprising a scraper member for scraping off the developer from the cleaning brush, wherein an incursion amount of the cleaning brush with respect to the image bearer is $\alpha$ (mm), and an incursion amount of the cleaning brush with respect to the scraper member is $\beta$ (mm), $\alpha \geqq \beta$ is satisfied.

13. The electrophotographic apparatus according to claim 11, wherein the lubricant contains particles of primary particle diameters of 10 to 100 nm.

14. The electrophotographic apparatus according to claim 11, wherein the lubricant is prepared by mixing an additive 5 to 20 wt % with toner 100 wt %.

* * * * *

UNITED STATES PATENT AND TRADEMARK OFFICE

CERTIFICATE OF CORRECTION

PATENT NO. : 6,954,609 B2
DATED : October 11, 2005
INVENTOR(S) : Masahiro Ito

It is certified that error appears in the above-identified patent and that said Letters Patent is hereby corrected as shown below:

Column 5,
Line 30, “laid” should read -- made --.

Column 9,
Line 34, “well” should be deleted.

Column 13,
Line 52, “born” should read -- boron --.

Column 14,
Line 36, “followings” should read -- following --;
Line 40, “S($mm^{2/dot}$)” should read -- S($mm^2$/dot) --; and
Line 59, “are” should be deleted.

Signed and Sealed this

Twenty-first Day of March, 2006

JON W. DUDAS
*Director of the United States Patent and Trademark Office*